US006623414B2

(12) United States Patent
Ohtsubo

(10) Patent No.: US 6,623,414 B2
(45) Date of Patent: Sep. 23, 2003

(54) METHOD AND APPARATUS FOR PRODUCING A COMPRESSION PRESERVATION BAG

(75) Inventor: Ryoichi Ohtsubo, Sakurai (JP)

(73) Assignee: Aru Corporation, Sakurai (JP)

( * ) Notice: Subject to any disclaimer, the term of this patent is extended or adjusted under 35 U.S.C. 154(b) by 0 days.

(21) Appl. No.: 10/245,291

(22) Filed: Sep. 18, 2002

(65) Prior Publication Data

US 2003/0022779 A1 Jan. 30, 2003

Related U.S. Application Data

(62) Division of application No. 09/579,573, filed on May 27, 2000, now Pat. No. 6,511,406.

(30) Foreign Application Priority Data

May 27, 1999 (JP) ..... 11-147659

(51) Int. Cl.[7] ..... B31B 1/90

(52) U.S. Cl. ..... 493/214; 493/212; 53/133.4

(58) Field of Search ..... 493/212, 213, 493/214, 927; 53/133.4, 139.2, 412, 416; 156/66; 383/63, 64

(56) References Cited

U.S. PATENT DOCUMENTS 4,372,793 A * 2/1983 Herz ..... 156/66
4,894,975 A * 1/1990 Ausnit ..... 53/412
4,909,017 A * 3/1990 McMahon et al. ..... 53/410
5,335,997 A * 8/1994 Kanemitsu et al. ..... 383/63
5,564,259 A * 10/1996 Stolmeier ..... 53/410
5,937,615 A * 8/1999 Forman ..... 53/133.4
5,956,926 A * 9/1999 O'Connor et al. ..... 53/429
6,044,621 A * 4/2000 Malin et al. ..... 53/412
6,099,451 A * 8/2000 Mulder et al. ..... 493/214

* cited by examiner

*Primary Examiner*—Scott A. Smith
*Assistant Examiner*—Nathaniel Chukwurah
(74) *Attorney, Agent, or Firm*—Keating & Bennett, LLP

(57) ABSTRACT

A method of producing a compression preservation bag includes the following first step and second step, thus allowing the longitudinal and widthwise lengths thereof to easily changed, and thus, providing for a wide size variation of the bag. The first step is carried out to form a rectangular, flat, cylindrical, and bottomed bag part formed of a laminate film and having a mouth portion at one end thereof in a longitudinal direction thereof. The second step is carried out to install a closing structure made of synthetic resin and having a length corresponding to a length of the mouth portion of the bag part on a region in the vicinity of the mouth portion of the bag part by thermal fusion or the like. The closing structure functions to freely open and close the mouth portion of the bag part.

8 Claims, 11 Drawing Sheets

METHOD AND APPARATUS FOR PRODUCING A COMPRESSION PRESERVATION BAG

This application is a Divisional of U.S. patent application Ser. No. 09/579,573 filed May 27, 2000, currently pending. Now U.S. Pat. No. 6,511,406.

BACKGROUND OF THE INVENTION

1. Field of the Invention

The present invention relates to a method of producing a compression preservation bag, and more particularly to a method of producing a compression preservation bag having, in an opening portion of a bag part, a closing means such as a fastener or a chuck having convexities and concavities which can engage each other.

2. Description of the Prior Art

Examined Japanese Patent Publication No. 64-10178 discloses a method of automatically and successively producing a bag 1 provided with a chuck.

The method is described below with reference to FIGS. 12 and 13. Initially, a chuck 3 having male and female sides 3*a* and 3*b* engaging each other is successively inserted between two rectangular belt-shaped bag-forming films 2*a* and 2*b*. Concurrently, as shown in FIG. 13, an insertion tape 4 having one surface with heat-sealing property is inserted between the male side 3*a* and the female side 3*b* such that the insertion tape 4 is disposed on the inner side of a portion of the male and female sides 3*a* and 3*b* to be heat-sealed. Holes 5 are punched through the insertion tape 4 and the male side 3*a* and the female side 3*b* of the chuck 3 by a punch at regular intervals corresponding to a longitudinal sealing interval.

Heat seal bars 8 are then applied to the outer surface of the bag-forming films 2*a* and 2*b* at regular intervals corresponding to the longitudinal length of the bag 1 such that the heat seal bars 8 are orthogonal to the feeding direction of the bag-forming films 2*a* and 2*b* to seal the bags in the longitudinal direction thereof. As a result, a region of the lower surface of the bag-forming film 2*a* and that of the upper surface of the bag-forming film 2*b* are sealed. At the same time, in the chuck 3, a region of the male side 3*a* and a region of the female side 3*b* are sealed through the punched holes 5. These sealed regions correspond to a sealing region of both sides of the bag 1.

Heat seal bars 9 are applied to the outer surface of the longitudinally sealed bag-forming films 2*a* and 2*b* along the insertion tape 4 to seal them in the widthwise direction thereof. As a result, a region of the lower surface of the bag-forming film 2*a* and a region of the upper surface of the bag-forming film 2*b* are sealed, and a region of the male side 3*a* and a region of the female side 3*b* are sealed. The male-side chuck 3*a* and the female-side chuck 3*b* are not sealed because the insertion tape 4 is inserted between the inner surface of the portion to be sealed thereof. The longitudinal sealing may be carried out after the widthwise sealing terminates.

The center of the longitudinally sealed portion is then cut longitudinally with a cutter to separate the bag-forming films 2*a* and 2*b* into a plurality of bags.

However, the above-described conventional art includes the step of automatically and successively producing the chuck-provided bags 1. Thus, it is not easy to change the longitudinal and widthwise sealing lengths. In particular, once the longitudinal length of the bag 1 corresponding to the longitudinal sealing length is set, the equipment of a producing line is set. Thus, in the conventional method of producing the chuck-provided bag, it is difficult to change the longitudinal length of the bag 1.

To change the longitudinal length of the bag 1, it is necessary to remodel the equipment of the producing line which is a costly process. That is, in the conventional art, it is difficult to vary the longitudinal and widthwise lengths of the bag, thus limiting the ability to produce bags of differing sizes.

SUMMARY OF THE INVENTION

Preferred embodiments of the present invention provide a method of producing a compression preservation bag allowing longitudinal and widthwise lengths thereof to be varied as desired, thus enabling the production of bags with a wide variety of sizes.

According to preferred embodiments of the present invention, a method of producing a compression preservation bag includes the steps of forming a cylindrical bag body having a closed bottom made of a material of synthetic resin and having a mouth portion at one end thereof in a longitudinal direction thereof; and installing a closing means, made of synthetic resin and having a length corresponding to a length of the mouth portion of the bag body, for opening and closing the mouth portion of the bag on a region in the vicinity of the mouth portion of the bag body.

In the method of producing the compression preservation bag, the bag body is formed of a laminate film which is rectangular and flat. The closing means-installing step includes preparing a belt-shaped closing tape having one or more pairs of concavities and convexities to engage each other; engaging the concavities and convexities of the closing tape; forming the closing tape annularly by thermally fusing both ends of the closing tape in a longitudinal direction thereof, with the convexities engaging the concavities, and by cutting the closing tape to desired lengths in the longitudinal direction thereof; and thermally fusing the closing tape into an inner side of the bag body such that the closing tape is disposed in the vicinity of the mouth portion of the bag body.

The bag body is made of a laminate film or other suitable material. One end of the closing tape is thermally fused to the other end of the closing tape in the longitudinal direction thereof such that a length of one end of a non-fusing portion of the closing tape in a widthwise direction thereof is shorter than a length of the other end of the non-fusing portion in the widthwise direction thereof, and the shorter portion of the non-fusing portion is thermally fused into the vicinity of the mouth portion of the bag part such that the shorter portion of the non-fusing portion is disposed at an end of an open side of the mouth portion of the bag body.

It is effective to form a tapered portion at one end and the other end of the non-fusing portion of the closing tape in the longitudinal direction thereof such that the tapered portions incline symmetrically to make the non-fusing portion gradually smaller toward the end of the open side of the mouth portion of the bag body.

According to the method of producing the compression preservation bag of preferred embodiments of the present invention, the closing means for freely opening and closing the mouth portion of the bag body is produced separately, and installed on the inner side of the mouth portion of the bag body produced in advance such that the closing means is disposed in the vicinity of the mouth portion of the bag body. Thus, in the method of producing the compression preservation bag, the closing means can be installed on the mouth portion of the bag body at a desired length which is determined by desired longitudinal and widthwise lengths of the desired bag body.

Thus, unlike the convention art, in the method of producing the compression preservation bag, when the longitudinal length of the bag body is changed, it is unnecessary to remodel the equipment of a producing line. Thus, the method of the present invention allows the longitudinal and widthwise lengths of the bag body to be varied as desired, and therefore, allows for the production of a wide variety of bag body sizes.

The above and further objects, features, aspects, and advantages of the present invention will be more fully apparent from the following detailed description with the accompanying drawings.

DETAILED DESCRIPTION OF THE PREFERRED EMBODIMENTS

Figure 1:
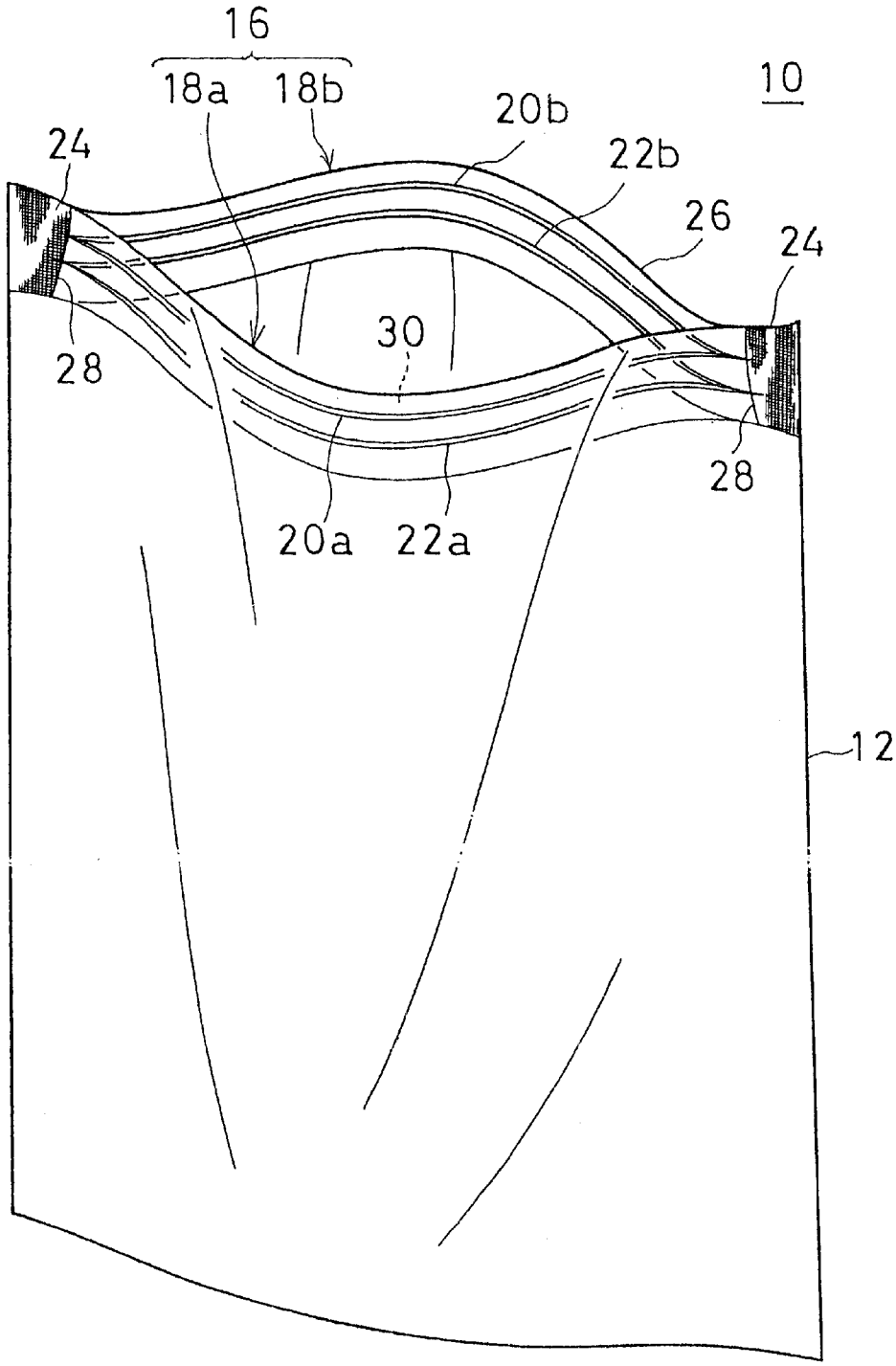
FIG. 1 is a perspective view showing an example of a compression preservation bag formed by a method of producing the compression preservation bag according to a preferred embodiment of the present invention.
Figure 2A:
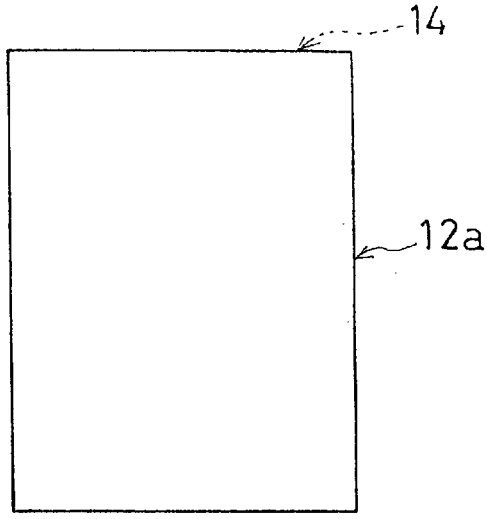
FIGS. 2(A) through 2(*c*) shows the steps of the method of producing the compression preservation bag according to a preferred embodiment of the present invention.
Figure 2B:
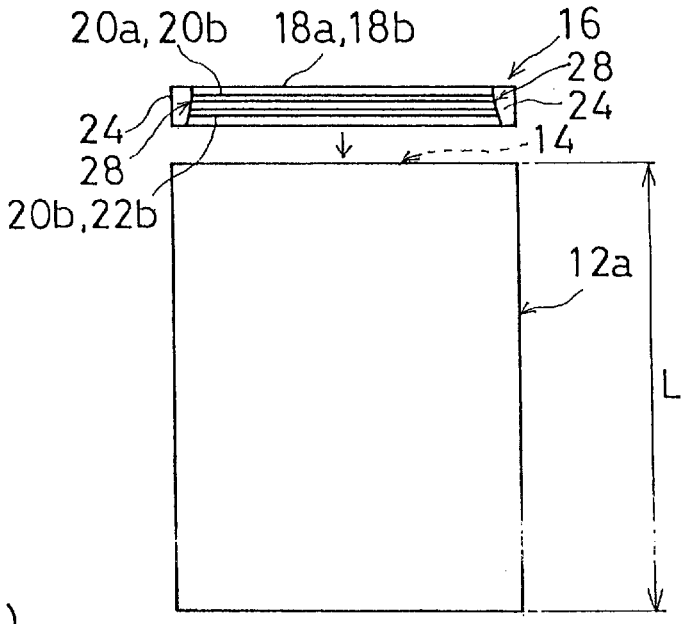
Figure 2C:
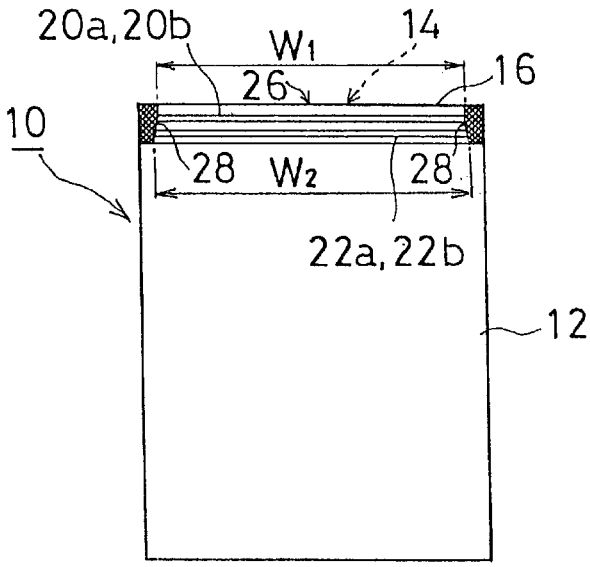
Figure 3:
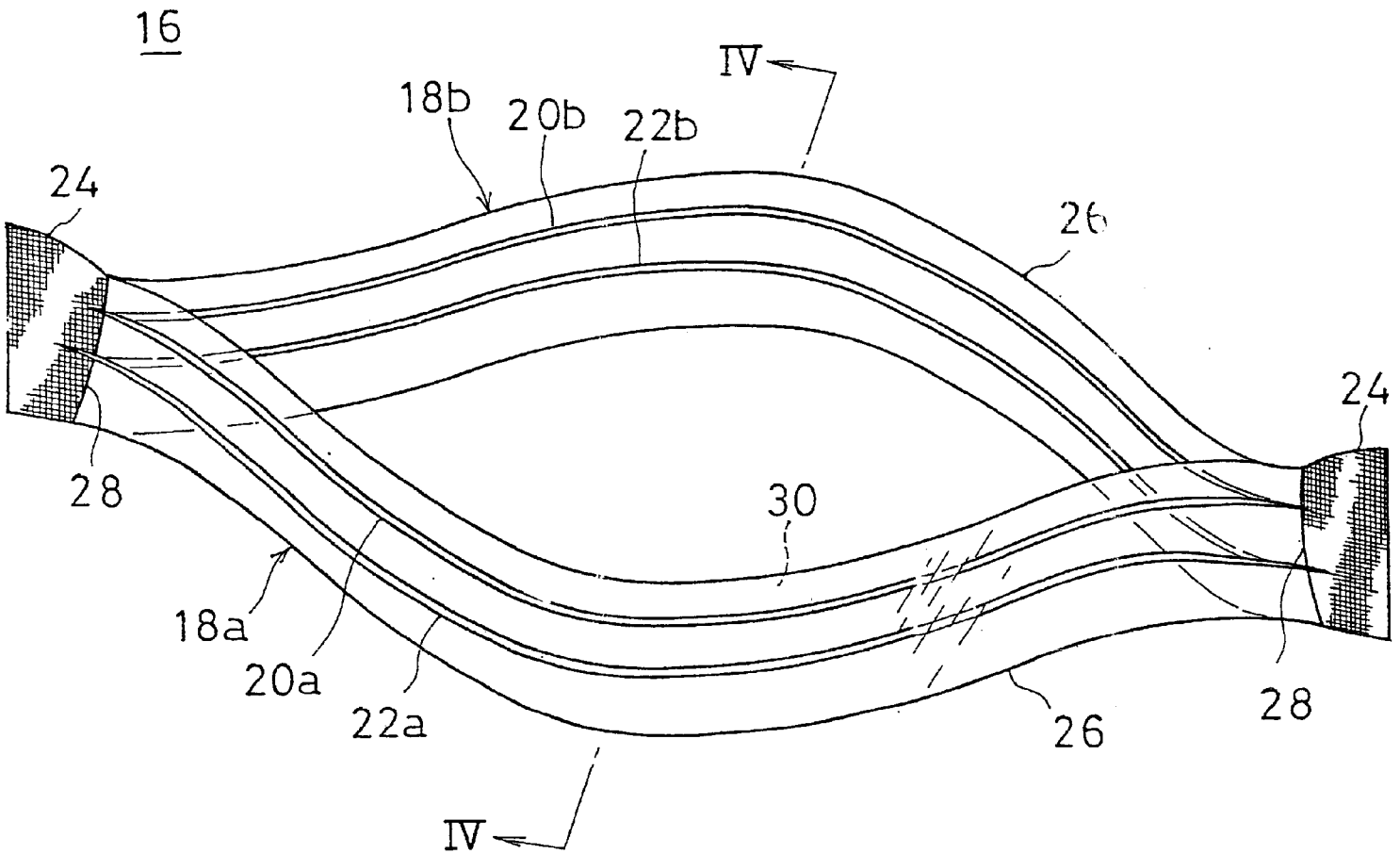
FIG. 3 is a perspective view showing an example of a closing structure provided on an open portion of the compression preservation bag shown in FIGS. 1 and 2(A) through 2(C).
Figure 4:
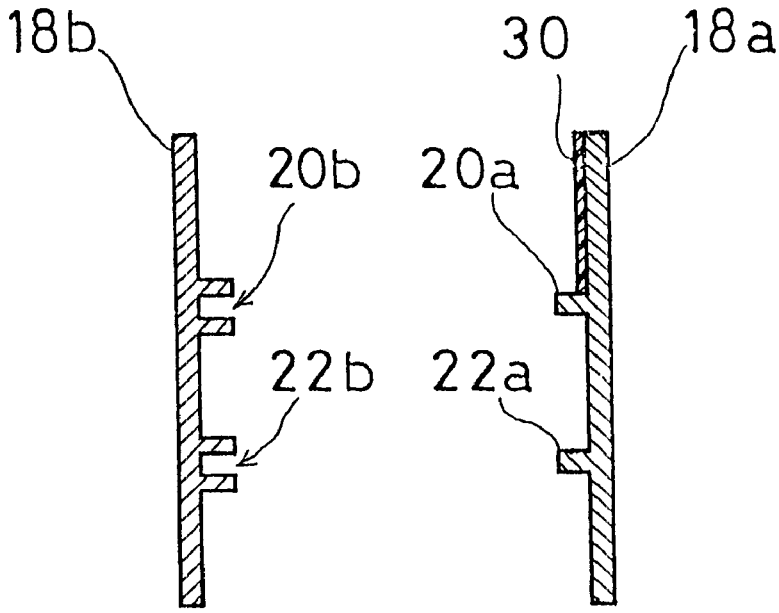
FIG. 4 is a sectional view taken along a line IV—IV of FIG. 3.

In the following, preferred embodiments of the compression preservation bag and the method for producing the compression preservation bag according to the present invention will be described with reference to the accompanying drawings FIG. 1 is a perspective view showing an example of a compression preservation bag formed by the method of producing the compression preservation bag according to a preferred embodiment of the present invention. FIGS. 2(A) through 2(C) show the steps of the method of producing the compression preservation bag according to a preferred embodiment of the present invention. FIG. 3 is a perspective view showing an example of a closing means provided on an open portion of the compression preservation bag shown in FIGS. 1 and 2. FIG. 4 is a sectional view taken along a line IV—IV of FIG. 3. The present invention relates to a method of producing a compression preservation bag. Initially, the construction of a compression preservation bag 10 produced by the method of producing the compression preservation bag according to a preferred embodiment of the present invention will be described below.

The compression preservation bag 10 includes a bag body 12 made of synthetic resin, other suitable material. To form the bag body 12, a laminate film, or other suitable material, is treated such that it is rectangular, flat, cylindrical, and has a bottom. The bag body 12 has an open portion 14 serving as a mouth portion thereof at one end in a longitudinal direction of the bag body 12. A closing tape 16 serving as a closing structure, made of synthetic resin, or other suitable material, for opening and closing the mouth portion is formed on the inner side portion of the bag body 12 such that the closing tape 16 is disposed in the vicinity of the mouth portion of the bag body 12. The closing tape 16 of a preferred embodiment has two pairs of convexities and concavities that engage each other and are disposed on the inner side portion of the bag body 12 such that the convexities and concavities are disposed in the vicinity of the open portion 14 of the bag body 12.

The closing tape 16 includes rectangular and belt-shaped tape components 18*a* and 18*b*. Each of the tape components 18*a* and 18*b* has a length corresponding to the length of the open portion 14. One tape component 18*a* has convexities 20*a* and 22*a* extending from one side portion thereof to the other side portion thereof in a longitudinal direction of the tape component 18*a*. The convexities 20*a* and 22*a* are spaced at a desired interval in the widthwise direction of the tape component 18*a*.

The other tape component 18*b* has concavities 20*b* and 22*b* extending from one side portion thereof to the other side portion thereof in a longitudinal direction of the tape component 18*b*. The concavities 20*b* and 22*b* are spaced at the desired interval in the widthwise direction of the tape component 18*b* such that the concavities 20*b*, 22*b* engage the convexities 20*a*, 22*a* of the tape component 18*a*, respectively.

The closing tape 16 is annularly configured by disposing the tape components 18*a* and 18*b* such that the concavity 20*b* engages the convexity 20*a*, and the concavity 22*b* engages the convexity 22*a*, and further by fixing both end portions of each of the tape components 18*a* and 18*b* in the longitudinal direction thereof to each other with a sealing method, such as thermal fusion or other suitable methods. A fusing portion 24 is provided at both end portions of each of the tape components 18*a* and 18*b* in the longitudinal direction thereof. The annular closing tape 16 is fixed to the inner side portion of the bag body 12 with a sealing method, such as impulse welding or other suitable sealing method, such that the closing tape 16 is disposed in the vicinity of the open portion 14 of the bag body 12.

As shown in FIG. 2, the annular closing tape 16 is configured such that a length $W_1$ of one end of a non-fusing portion 26 in its widthwise direction is shorter than a length $W_2$ of the other end of the non-fusing portion 26 in its widthwise direction. In this case, to dispose one end of the non-fusing portion 26 having the length $W_1$ at the upper end portion of the open portion 14 of the bag body 12, both end portions of the closing tape 16 in its longitudinal direction are sealed to the inner side portion of the bag body 12 such that both end portions of the closing tape 16 are disposed in the vicinity of the open portion 14 of the bag body 12. A tapered portion 28 is provided at both longitudinal end portions of the non-fusing portion 26 of the closing tape 16. In this preferred embodiment, the tapered portion 28 is provided at both end portions of the non-fusing portion 26 in the longitudinal direction thereof such that both longitudinal end portions of the non-fusing portion 26 incline symmetrically to make the non-fusing portion 26 gradually smaller toward the upper end of the open portion 14 of the bag body 12.

As described above, the compression preservation bag 10 of a preferred embodiment of the present invention has the non-fusing portion 26 satisfying the condition of the length $W_1$>the length $W_2$ such that one end portion of the non-fusing portion 26 having the length $W_1$ is disposed at the upper end portion of the open portion 14 of the bag body 12. Due to this construction, when the compression preservation bag 10 is opened by unsealing the closing tape 16, a force acting on the closing tape 16 can be dispersed along the tapered portion 28 in the shape of a line. Thus, the force does not concentrate on either end of the closing tape 16 in its longitudinal direction. That is, the possibility that both end portions of the closing tape 16 will separate is greatly reduced. Accordingly, air is prevented from entering and leaving the bag body 12.

A treating layer 30 is provided on the tape component 18*a* of the closing tape 16 by applying a treating liquid to the tape component 18*a* and drying it. As shown in FIGS. 3 and 4, the treating layer 30 of a preferred embodiment of the present invention is provided only on a portion of the tape component 18*a* which is disposed above the upper convexity 20*a* of the tape component 18*a*. The treating liquid of this embodiment includes a mixture of medium serving as its stock solution, thinner, and a coloring liquid. The treating layer 30 prevents the inner surface of the tape component 18*a* from being thermally fused together with the inner surface of the tape component 18*b* when the outer surface of the tape component 18*a* and the tape component 18*b* are thermally fused together with the inner surface of the bag body 12.

The method of producing the compression preservation bag 10 of the embodiment is described below with reference to FIGS. 2(A)–(C), 3, 4, 5, 6, 9, 10, and 11.

As shown in FIG. 2(A), initially, a rectangular, flat bag part 12*a* having a closed bottom portion and an open top portion 14 at one end thereof in its longitudinal direction is provided. The bag part 12*a* constitutes the bag body 12. The bag body 12 is formed of synthetic resins of ethylene-vinylalcohol copolymer (trade name: Ebahru) located as the innermost layer, polyethylene, nylon, polyethylene, nylon, and low density polyethylene (trade name: Rinia-rohren) laminated sequentially in this order. The bag body 12 may also be formed of synthetic resins of ethylene-vinylalcohol copolymer located as the innermost layer, polyethylene, low density polyethylene, polyethylene, nylon, polyethylene, low density polyethylene, polyethylene, and ethylene-vinylalcohol copolymer laminated sequentially in this order.

The rectangular and belt-shaped tape components 18*a* and 18*b* each having a length corresponding to that of the open portion 14 of the bag body 12 are prepared. The convexities 20*a* and 22*a* are formed on the tape component 18*a*. The concavities 20*b* and 22*b* that engage the convexities 20*a* and 22*a*, respectively are formed on the tape component 18*b*. More specifically, as described above, the tape component 18*a* has the convexities 20*a* and 22*a* formed thereon, while the tape component 18*b* has the concavities 20*b* and 22*b* formed thereon. As described above, the treating layer 30 is formed in advance in only the portion, of the tape component 18*a*, disposed above the upper convexity 20*a* of the tape component 18*a*.

Figure 5:
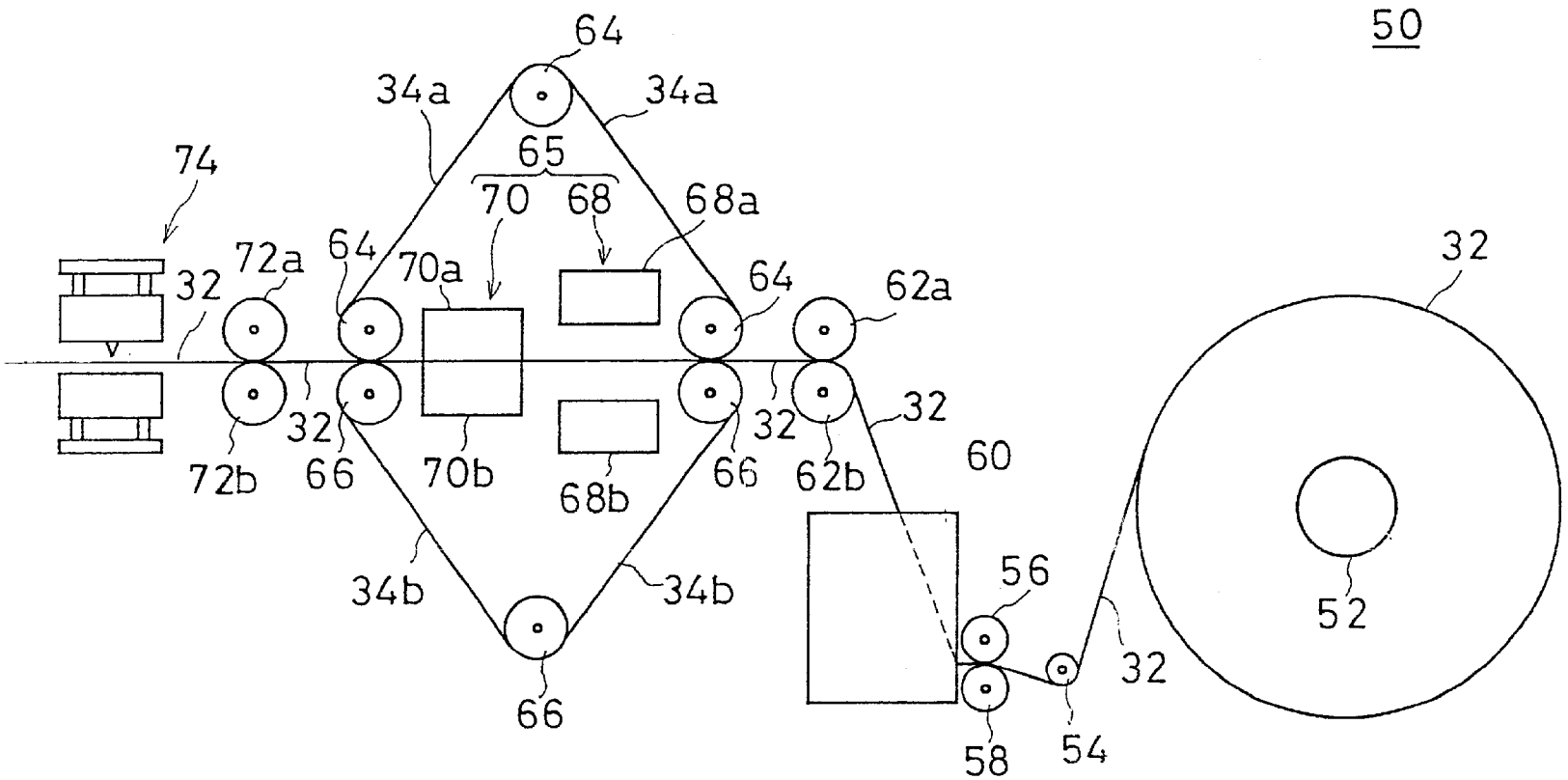
FIG. 5 shows a closing structure-producing apparatus shown in FIG. 3 and an example of the producing step to be carried out by using the closing structure-producing apparatus.
Figure 6:
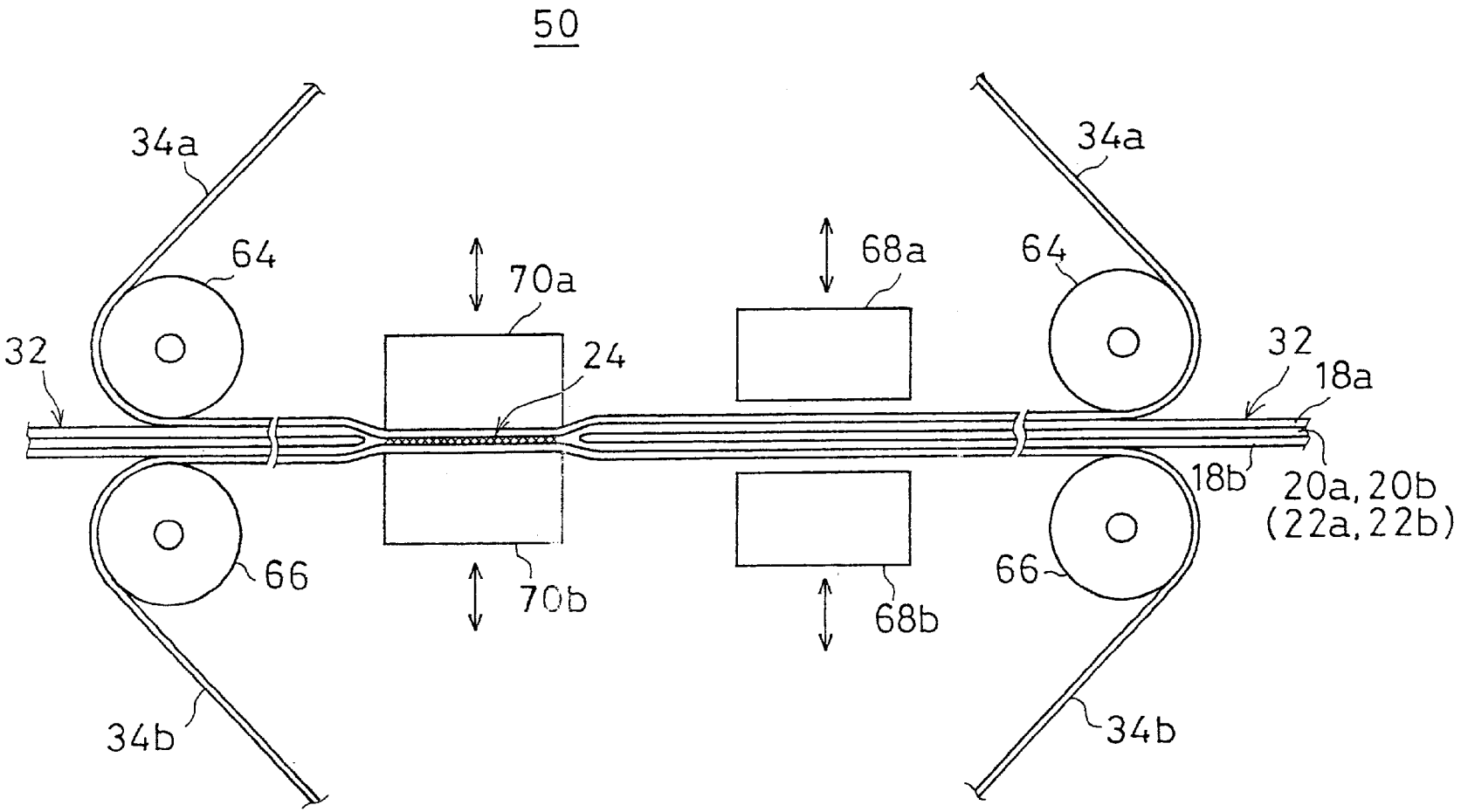
FIG. 6 shows enlarged main portions of the closing structure-producing apparatus shown in FIG. 5 and main portions of the producing step to be carried out by using the closing structure-producing apparatus.

A closing structure-producing apparatus 50 shown in FIGS. 5 and 6 combines the tape components 18*a* and 18*b* with each other into the annular closing tape 16 as shown in FIG. 3. That is, a holding roller 52 of the closing structure-producing apparatus 50 holds an engaged member 32 including the prepared tape component 18*a* and the prepared tape component 18*b* combined with each other by engaging the convexities 20*a* and 20*b* and the concavities 20*b* and 22*b*, respectively.

The engaged member 32 of the tape components 18*a* and 18*b* held by the holding roller 52 is unrolled and fed downstream by a feed roller 56 and a driven roller 58 to be driven thereby through a guide roller 54 and then fed to a guide member 60. The engaged member 32 guided upward by the guide member 60 is guided downstream by feed rollers 62*a*, 62*b*.

At the downstream side of the feed rollers 62*a*, 62*b*, a heat-sealing device 65 is provided for forming the annular closing tape 16 and a cutting device 74 spaced at a desired interval from the heat-sealing device 65 is also provided. The heat-sealing device 65 thermally fuses both longitudinal end portions of the engaged tape components 18*a* and 18*b* together. Then, the cutting device 74 cuts the fused tape components 18*a* and 18*b* to a desired length to form the annular closing tape 16.

That is, rotating band members 34*a* and 34*b* which comprise a pair is located at upper and lower sides of the engaged member 32, respectively and downstream from the feed rollers 62*a*, 62*b* that feed the engaged member 32 downstream. The band members 34*a* and 34*b* are constructed such that the rotating band member 34*a* is rotated clockwise, as seen in FIG. 5, by three rollers 64, 64, and 64, one of which is a driving roller, and the rotating band member 34*b* is rotated clockwise by three rollers 66, 66, and 66, one of which is a driving roller.

The band members 34*a* and 34*b* serve as a device for preventing the tape components 18*a* and 18*b* of the engaged member 32 from adhering to a pressing surface of the heat-sealing device 65 which will be described later. Each of the band members 34*a* and 34*b* is made of an adherence prevention material of nonwoven cloth made of Teflon. In addition, it is possible to use the band members 34*a* and 34*b* made of a metal band having silicon applied to its surface, a tape made of polyfluoroethylene, and other suitable material.

After the tape components 18*a* and 18*b* of the engaged member 32 are guided downstream by the feed rollers 62*a*, 62*b*, the tape components 18*a* and 18*b* are fed downstream together with by the pair of the upper and lower band members 34*a* and 34*b*, with the tape components 18*a* and 18*b* being sandwiched and held between the band members 34*a* and 34*b*. At this time, the fusing portion 24 is heated by a heating member 68 of the heat-sealing device 65 and then, cooled immediately by a cooling member 70. Thereby, the tape components 18*a* and 18*b* are thermally fused together at both end portions thereof in the longitudinal direction thereof. The tape components 18*a* and 18*b* which have been thermally fused together at the desired interval in the longitudinal direction thereof are fed downstream through guide rollers 72*a* and 72*b*. Then, the tape components 18*a* and 18*b* are cut to the predetermined length by the cutting device 74 to form the annular closing tapes 16.

Figure 7:
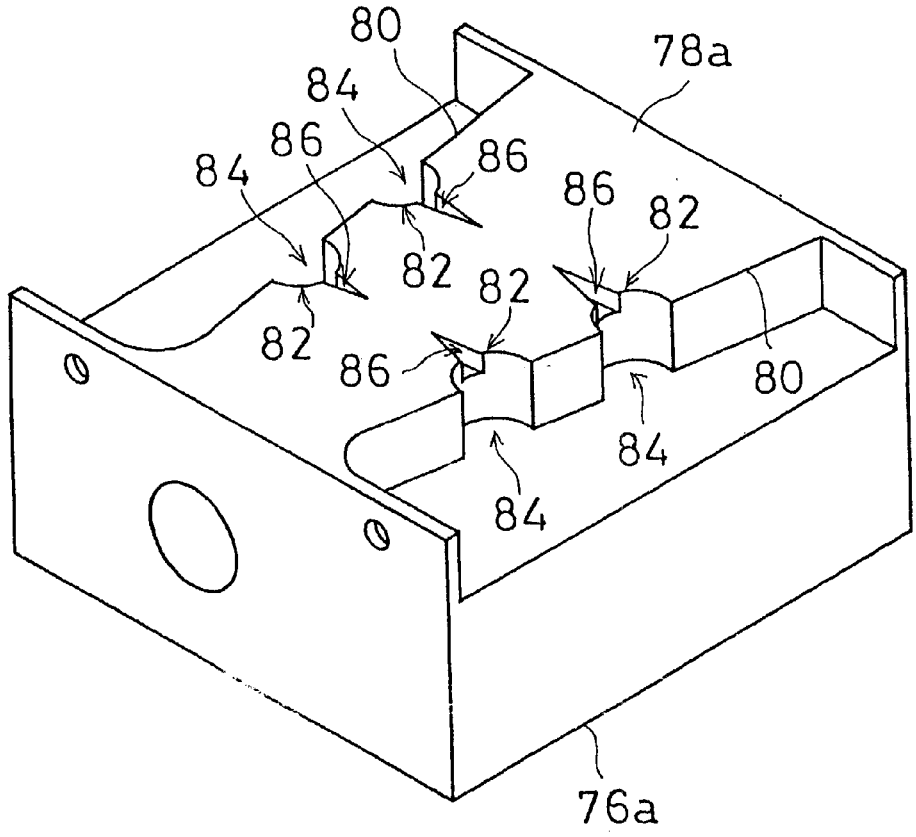
FIG. 7 is a perspective view showing an example of an upper die of a heat-sealing device to be applied to the closing structure-producing apparatus shown in FIGS. 5 and 6 and the producing step to be carried out by using the closing structure-producing apparatus.
Figure 8:
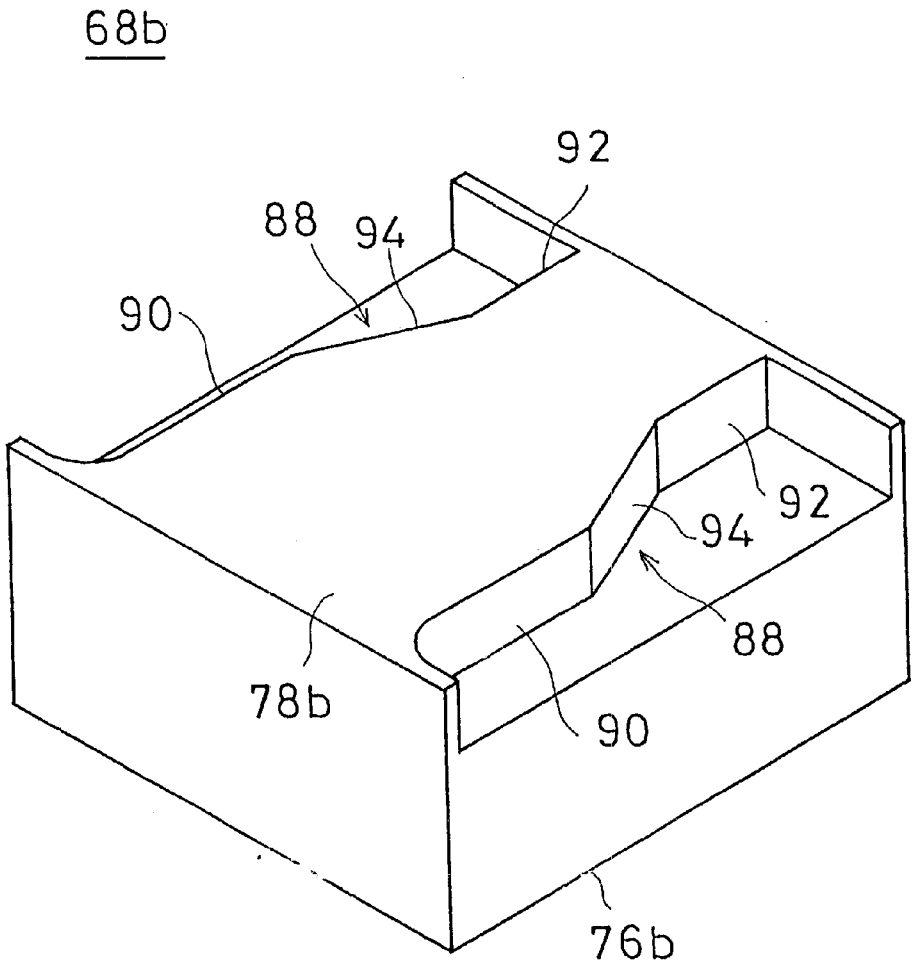
FIG. 8 is a perspective view showing an example of a lower die of the heat-sealing device to be applied to the closing means-producing apparatus shown in FIGS. 5 and 6 and the producing step to be carried out by using the apparatus.

The heating member 68 of the heat-sealing device 65 and the cooling member 70 thereof will be described below with a particular reference to FIGS. 7, 8, and 9.

The heating member 68 having the function of a hot plate to be used in the heat-sealing method includes upper and lower dies 68*a* and 68*b*. The upper die 68*a* is disposed above the engaged member 32 that is fed from the upstream side. The lower die 68*b* is disposed below the upper die 68*a* such that the engaged member 32 is fed downstream between the upper die 68*a* and the lower die 68*b*.

The upper die 68*a* includes an approximately rectangular solid-shaped block member 76*a*. A pressing surface 78*a* is provided in the central region of the lower surface of the block member 76*a* which confronts the lower die 68*b*, wherein both side surfaces of the pressing surface 78*a* incline symmetrically. The pressing surface 78*a* presses and thermally fuses portions of the engaged member 32, spaced at regular intervals in the longitudinal direction thereof, while the engaged member 32 is being fed from the upstream side. On both side surfaces of the pressing surface 78*a*, a tapered portion 80 is provided for forming the tapered portion 28 at both ends of the non-fusing portion 26 in its longitudinal direction.

Two accommodation portions 82, 82 are provided on each tapered portion 80 provided on the each side surface of the pressing surface 78*a*, such that the accommodation portions 82, 82 are spaced at a desired interval in the longitudinal direction of the tapered portion 80. Each accommodation portion 82 is composed of a first accommodation concavity 84 substantially semi-cylindrical and a second accommodation concavity 86 communicating with the first accommodation concavity 84 and having a shape substantially similar to an isosceles triangle in a plane view.

The lower die 68*b* includes an approximately rectangular solid-shaped block member 76*b*. A pressing surface 78*b* that confronts the pressing surface 78*a* of the upper die 68*a* is provided on the upper surface of the block member 76*b*. The area of the pressing surface 78*b* is greater than the area of the pressing surface 78*a*. A tapered portion 88 approximately corresponding to the tapered portion 80 of the pressing surface 78*a* is provided on both side surfaces of the pressing surface 78*b*. The tapered portion 88 includes a wide linear portion 90, a narrow linear portion 92, and a tapered portion 94 located between the wide linear area 90 and the narrow linear area 92.

Figure 9:
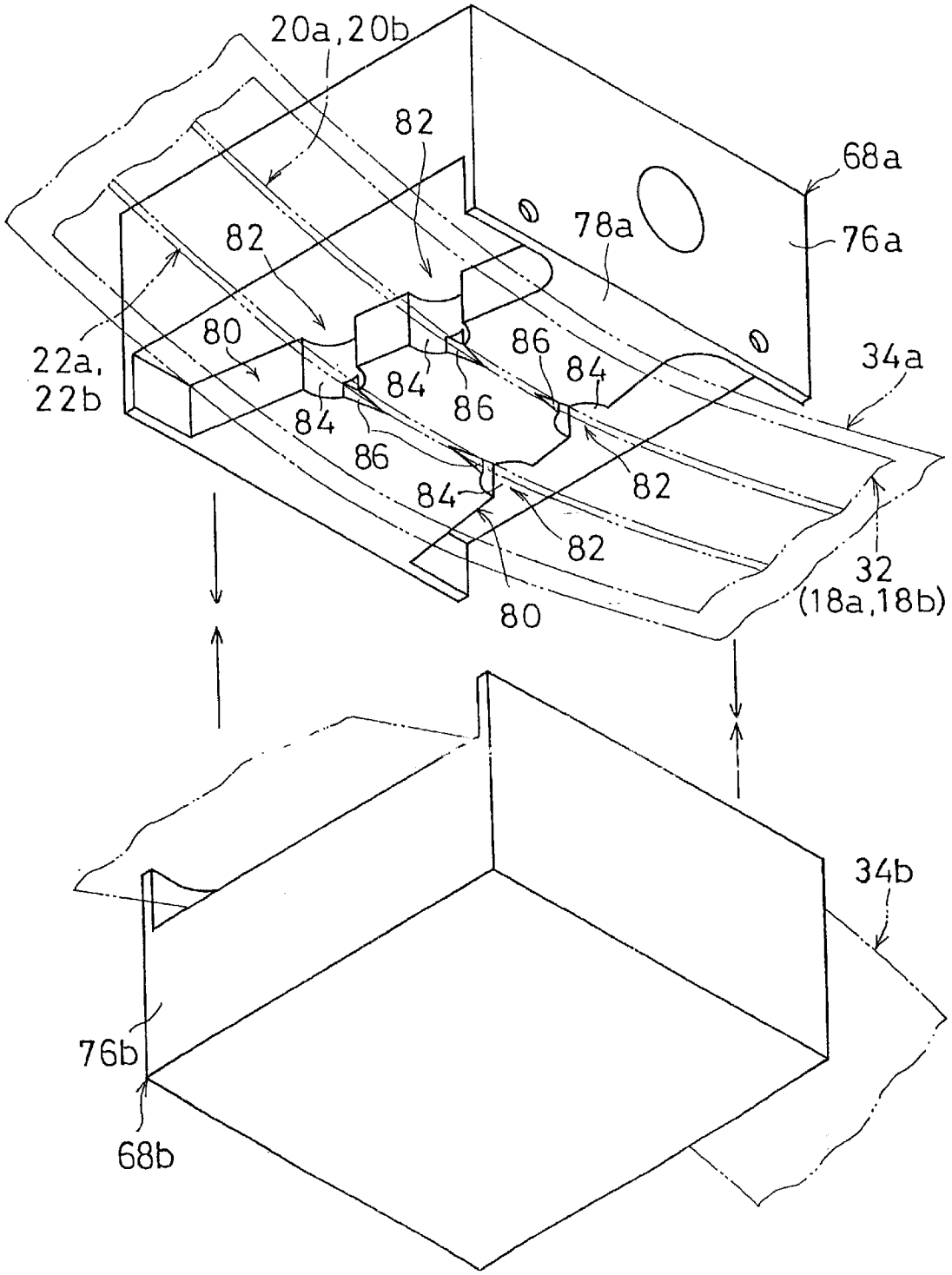
FIG. 9 is an exploded perspective view showing an example of a step of pressing an engaged member with the lower die of the heat-sealing device shown in FIG. 7 and the lower die of the heat-sealing device shown in FIG. 8.

When the heat-sealing device 65 is actuated to press the tape components 18*a* and 18*b* of the engaged member 32 with the upper die 68*a* and the lower die 68*b*, as best shown in FIG. 9, the desired portion of the engaged member 32 in the longitudinal direction thereof is accommodated in the accommodation portion 82. More specifically, the fusing portion-forming portion of the convexities 20*a*, 22*a* and the concavities 20*b* and 22*b* all located at both end portions of the annular closing tape 16 in its longitudinal direction are accommodated in the accommodation portion 82. The portions located at both ends of the annular closing tape 16 are pressed and thermally fused between the pressing surface 78*a* of the upper die 68*a* and the pressing surface 78*b* of the lower die 68*b*. Then, the engaged member 32 is pressed by the upper die 70*a* of the cooling member 70 and the lower die 70*b* thereof and cooled immediately. The upper die 70*a* of the cooling member 70 and the lower die 70*b* thereof have substantially similar constructions as that of the upper die 68*a* of the heating member 68 and that of the lower die 68*b* thereof, respectively.

As shown in FIGS. 1, 2, and 3, the tapered portion 28 is formed at the boundary between the fusing portion 24 and the non-fusing portion 26.

As shown in FIG. 2B, the annular closing tape 16 that has been formed in this manner is installed on the inner side portions of the bag body 12 such that it is disposed in the vicinity of the open portion 14 of the bag body 12. Then, the outer surface of the tape components 18*a* and 18*b* of the closing tape 16 and the inner surface of the bag body 12 are thermally fused together at desired positions thereof by impulse sealing method, or other suitable method. In this case, as best shown in FIG. 2C, to dispose one end of the non-fusing portion 26 of the closing tape 16 having the length $W_1$ at the upper end portion of the open portion 14 of the bag body 12, both end portions of the closing tape 16 in its longitudinal direction are thermally fused together with the inner side of the bag body 12 such that both end portions of the closing tape 16 are disposed in the vicinity of the open portion 14 of the bag body 12. Thereby, the compression preservation bag 10 having the closing tape 16 for opening and closing the open portion 14 of the bag body 12 is formed.

According to the method of producing the compression preservation bag 10 of a preferred embodiment of the present invention, the closing tape 16 for freely opening and closing the open portion 14 of the bag body 12 is separately produced, and then installed on the inner side of the open portion 14 of the bag body 12 produced in advance such that the closing tape 16 is disposed in the vicinity of the open portion 14 of the bag body 12. Thus, in the method of producing the compression preservation bag 10, the closing tape 16 can be installed on the open portion 14 of the bag body 12 in correspondence to the length, of the open portion 14 of the bag body 12, which is determined by desired longitudinal and widthwise lengths of the desired bag body 12.

Thus, unlike the conventional art, in the method of producing the compression preservation bag according to a preferred embodiment of the present invention, when a change of the longitudinal length L of the bag body 12 is desired, it is unnecessary to remodel the equipment of a production line. That is, the method of the present invention facilitates changing the longitudinal length L of the bag body 12, i.e., provides for a wide variety of bag body 12 sizes.

Figure 10:
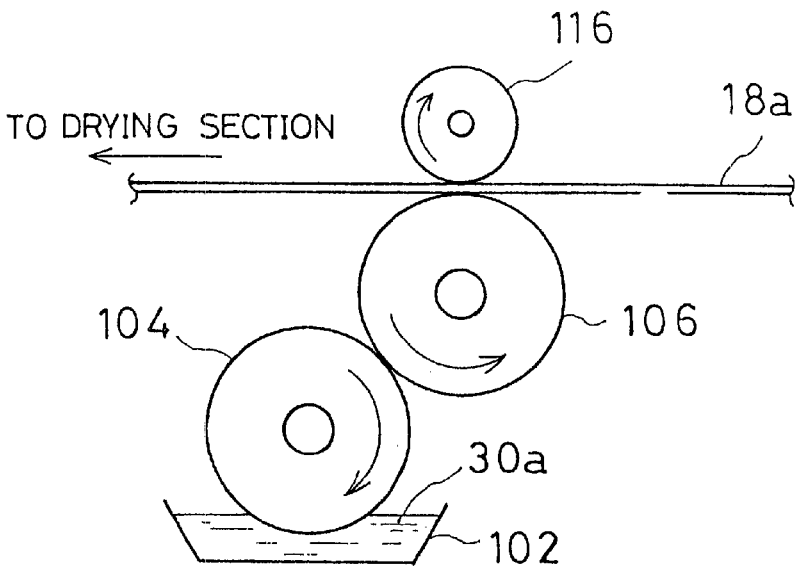
FIG. 10 shows an example of an application apparatus for applying a treating liquid to a portion of the closing structure.

In a preferred embodiment of the present invention, the treating layer 30 is provided in advance in the portion disposed above the upper convexity 20*a* of the tape component 18*a* of the closing tape 16 by the above-described method. In addition, the treating layer 30 may be provided by an in-line system incorporated in a series of manufacturing processes to be carried out by the closing structure-producing apparatus 50 shown in FIG. 5. More specifically, the treating layer 30 may be provided by an application apparatus 100 as shown in FIGS. 10 and 11, before the engaged member 32 including the tape components 18*a* and 18*b* prepared to form the annular closing tape 16 is wound on the holding roller 52 of the closing structure-producing apparatus 50.

The application apparatus 100 includes a coating pan 102 containing a treating liquid 30*a* including a mixture of medium serving as its stock solution, thinner, and a coloring liquid. By the cooperative action of an application roll 104, a plate cylinder 106, and an impression drum 116, the treating liquid 30*a* is applied to the desired portion of the tape component 18*a* fed from the upstream side. As shown in FIG. 11, two convexities 108, 108 are formed on the peripheral surface of the plate cylinder 106 such that the convexities 108, 108 are disposed thereon by spacing them at a desired interval from one end portion of the plate cylinder 106 in its axial direction. A concavity 110 is disposed between the convexities 108 and 108. Another convexity 112 is provided having a desired length at the other end portion of the peripheral surface of the plate cylinder 106 in its axial direction. Thus, another concavity 114 is disposed between one of the convexities 108 and the convexity 112.

Figure 11:
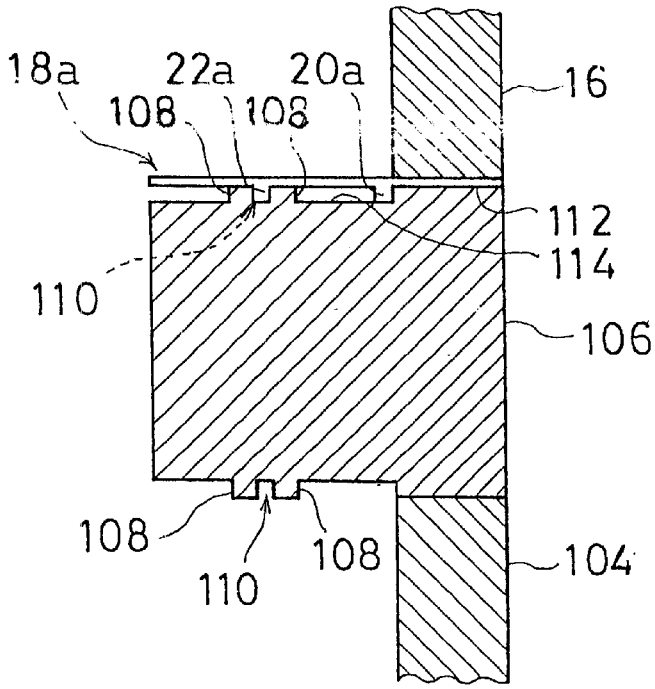
FIG. 11 is a sectional view showing main portions of the application apparatus shown in FIG. 10.
Figure 12:
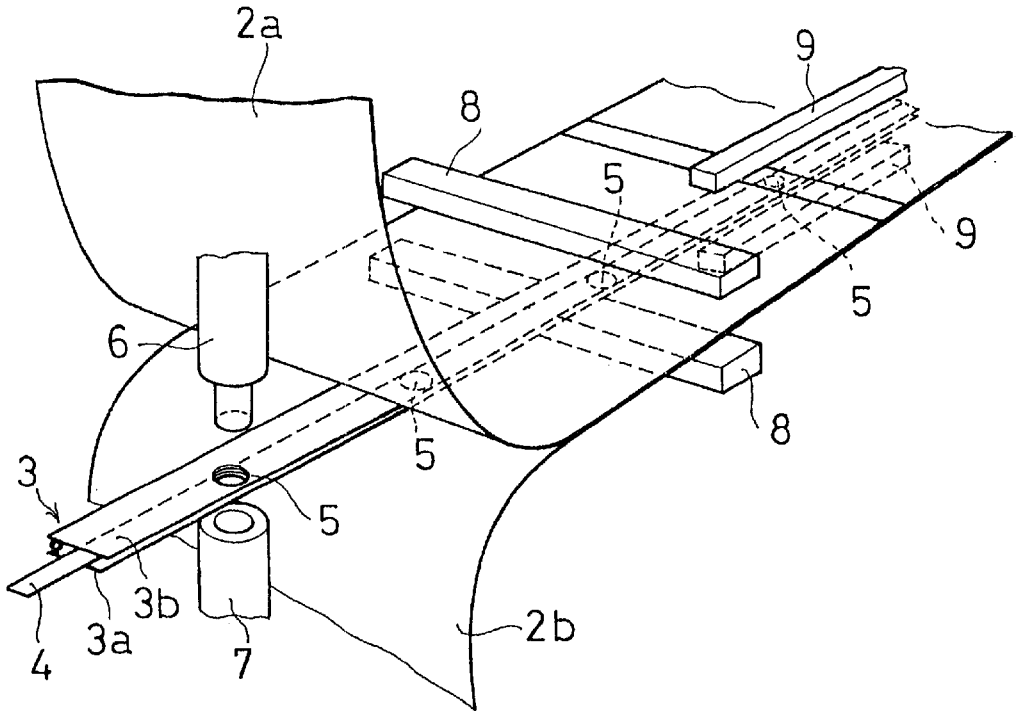
FIG.12 PRIOR ART
FIG. 12 is an explanatory view showing a conventional method, of producing a chuck-provided bag, constituting the background of the present invention.
Figure 13:
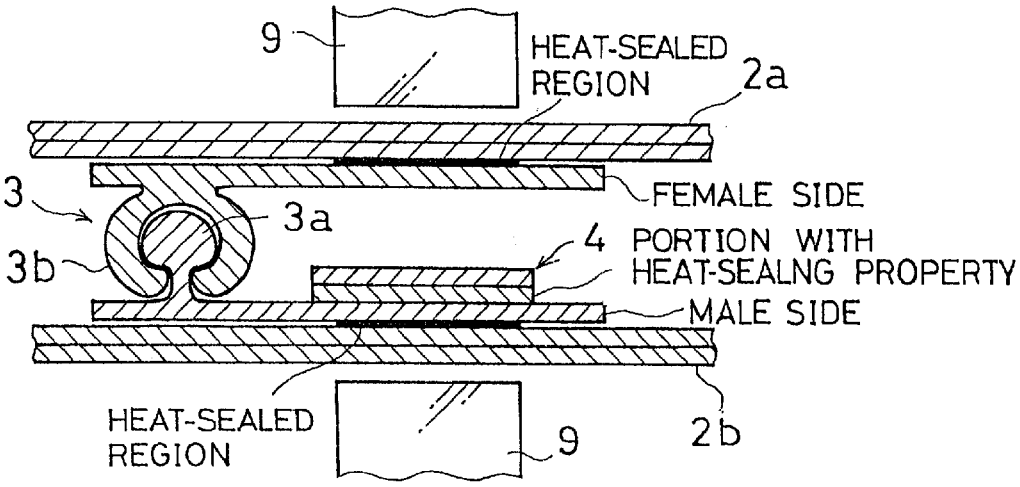
FIG.13 PRIOR ART
FIG. 13 is an explanatory view showing a section of a conventional chuck and a bag-forming material of an insertion portion of an insertion tape.

When the tape component 18*a* is fed to the application apparatus 100, as shown in FIG. 11, the one convexity 22*a* of the tape component 18*a* engages the concavity 110, and the other convexity 20*a* thereof engages a side-end surface of the concavity 114. Accordingly, the treating liquid 30*a* is applied to the portion located above the upper convexity 20*a* of the tape component 18*a*. Referring to FIG. 11, the treating liquid 30*a* is applied to the tape component 18*a* at only the right side thereof. The tape component 18*a* to which the treating liquid 30*a* has been applied is fed to a drying section (not shown) provided at the downstream side of the application apparatus 100 to dry the treating liquid 30*a*. In this manner, the treating liquid 30*a* is provided on the desired portion of the tape component 18*a* of the annular closing tape 16.

In the method of producing the compression preservation bag according to preferred embodiments of the present invention, it is possible to change the longitudinal and widthwise lengths of the bag part, namely, to allow a wide size variation of the bag. Unlike the conventional art, when a change of the longitudinal length of the bag part is desired, it is unnecessary to make a large-scale remodeling of the equipment of a production line. Therefore, compared with the conventional art, maintenance can be easily accomplished in accordance with the size of the bag part and thus the production costs are greatly reduced.

The invention may be embodied in other specific forms without departing from the spirit or essential characteristics thereof. The preferred embodiments are therefore to be considered in all respects as illustrative and not restrictive. The scope of the invention being indicated by the appended claims rather than by the foregoing description, and all changes which come within the meaning and range of equivalency of the claims are therefore intended to be embraced therein.

What is claimed is:

1. An apparatus for carrying out a method of producing a compression preservation bag according to a method comprising the steps of forming a cylindrical and bottomed bag part made of a material of synthetic resin and having a mouth portion at one end thereof in a longitudinal direction thereof, installing a closing structure, made of synthetic resin and having a length corresponding to a length of said mouth portion of said bag part, to freely open and close said mouth portion of said bag part, said closing structure is installed in a region of the bag part in the vicinity of said mouth portion of said bag part, wherein said bag part is formed of a laminate film which is rectangular and flat, said closing structure-installing step includes the steps of preparing a belt-shaped closing tape having at least one pair of concavities and convexities engaging each other, engaging said concavities and convexities of said closing tape to each other, forming said closing tape annularly by thermally fusing both end portions of said closing tape in a longitudinal direction thereof, wherein said convexities engage said concavities, and by cutting said closing tape to predetermined lengths in said longitudinal direction thereof, and thermally fusing said closing tape to an inner side of said bag part such that said closing tape is disposed in the vicinity of said mouth portion of said bag part;

said apparatus including a closing structure-producing apparatus to form said annular closing tape;

said closing means-producing apparatus having:

a heat-sealing device to thermally fuse both end portions of said closing tape in said longitudinal direction thereof, with said convexities and concavities engaging each other, and a cutting device to cut said closing tape thermally fused by said heat-sealing device to desired lengths in said longitudinal direction thereof;

said heat-sealing device including an upper die and a lower die opposed to said upper die;

said upper die having a block member, a pressing surface provided in a central region of a surface of said block member and a tapered portion provided on side surfaces of said block member, each of said tapered portions incline symmetrically, and at least one accommodation portion provided on each of said tapered portions such that said at least one accommodation portion is spaced at a desired interval in a longitudinal direction of said tapered portion to accommodate a portion of said at least one pair of convexities and concavities, located at both ends of said closing tape in the longitudinal direction thereof; and said lower die having a block member, a pressing surface provided on a surface of said block member and confronting said pressing surface of said upper die, and a tapered portion provided on side surfaces of said pressing surface thereof and approximately confronting said tapered portion of said upper die.

2. An apparatus for producing a compression preservation bag according to claim 1, wherein each of said at least one accommodation portions includes a first accommodation concavity having a substantially semi-cylindrical shape, and a second accommodation concavity having a substantially triangular shape.

3. An apparatus for carrying out a method of producing a compression preservation bag according to a method comprising the steps of forming a cylindrical and bottomed bag part made of a material of synthetic resin and having a mouth portion at one end thereof in a longitudinal direction thereof, installing a closing structure, made of synthetic resin and having a length corresponding to a length of said mouth portion of said bag part, to freely open and close said mouth portion of said bag part, said closing structure is installed in a region of the bag part in the vicinity of said mouth portion of said bag part, wherein said bag part is formed of a laminate film which is rectangular and flat, said closing structure-installing step includes the steps of preparing a belt-shaped closing tape having at least one pair of concavities and convexities engaging each other, engaging said concavities and convexities of said closing tape to each other, forming said closing tape annularly by thermally fusing both end portions of said closing tape in a longitudinal direction thereof, wherein said convexities engage said concavities, and by cutting said closing tape to predetermined lengths in said longitudinal direction thereof, thermally fusing said closing tape to an inner side of said bag part such that said closing tape is disposed in the vicinity of said mouth portion of said bag part, thermally fusing one end portion to the other end portion of said closing tape in said longitudinal direction thereof, such that a length of one end portion of a non-fusing portion of said closing tape in a widthwise direction thereof is shorter than a length of the other end portion of said non-fusing portion in said widthwise direction thereof, and thermally fusing said shorter portion of said non-fusing portion in the vicinity of said mouth portion of said bag part, such that said shorter part of said non-fusing portion is disposed closer to an open side of said mouth portion of said bag part than said other end portion of said non-fusing portion;

said apparatus including a closing structure-producing apparatus to form said annular closing tape;

said closing means-producing apparatus having:

a heat-sealing device to thermally fuse both end portions of said closing tape in said longitudinal direction thereof, with said convexities and concavities engaging each other, and a cutting device to cut said closing tape thermally fused by said heat-sealing device to desired lengths in said longitudinal direction thereof;

said heat-sealing device including an upper die and a lower die opposed to said upper die;

said upper die having a block member, a pressing surface provided in a central region of a surface of said block member and a tapered portion provided on side surfaces of said block member, each of said tapered portions incline symmetrically, and at least one accommodation portion provided on each of said tapered portions such that said at least one accommodation portion is spaced at a desired interval in a longitudinal direction of said tapered portion to accommodate a portion of said at least one pair of convexities and concavities, located at both ends of said closing tape in the longitudinal direction thereof; and said lower die having a block member, a pressing surface provided on a surface of said block member and confronting said pressing surface of said upper die, and a tapered portion provided on side surfaces of said pressing surface thereof and approximately confronting said tapered portion of said upper die.

4. An apparatus for carrying out a method of producing a compression preservation bag according to a method comprising the steps of forming a cylindrical and bottomed bag part made of a material of synthetic resin and having a mouth portion at one end thereof in a longitudinal direction thereof, installing a closing structure, made of synthetic resin and having a length corresponding to a length of said mouth portion of said bag part, to freely open and close said mouth portion of said bag part, said closing structure is installed in a region of the bag part in the vicinity of said mouth portion of said bag part, wherein said bag part is formed of a laminate film which is rectangular and flat, said closing structure-installing step includes the steps of preparing a belt-shaped closing tape having at least one pair of concavities and convexities engaging each other, engaging said concavities and convexities of said closing tape to each other, forming said closing tape annularly by thermally fusing both end portions of said closing tape in a longitudinal direction thereof, wherein said convexities engage said concavities, and by cutting said closing tape to predetermined lengths in said longitudinal direction thereof, thermally fusing said closing tape to an inner side of said bag part such that said closing tape is disposed in the vicinity of said mouth portion of said bag part, thermally fusing one end portion to the other end portion of said closing tape in said longitudinal direction thereof, such that a length of one end portion of a non-fusing portion of said closing tape in a widthwise direction thereof is shorter than a length of the other end portion of said non-fusing portion in said widthwise direction thereof, and thermally fusing said shorter portion of said non-fusing portion in the vicinity of said mouth portion of said bag part, such that said shorter part of said non-fusing portion is disposed closer to an open side of said mouth portion of said bag part than said other end portion of said non-fusing portion, wherein a tapered portion is formed at one end portion and the other end portion of said non-fusing portion of said closing tape in said longitudinal direction thereof such that said tapered portions incline symmetrically to make said non-fusing portion gradually smaller toward said end portion of said open side of said mouth portion of said bag part;

said apparatus including a closing structure-producing apparatus to form said annular closing tape;

said closing means-producing apparatus having:

a heat-sealing device to thermally fuse both end portions of said closing tape in said longitudinal direction thereof, with said convexities and concavities engaging each other, and a cutting device to cut said closing tape thermally fused by said heat-sealing device to desired lengths in said longitudinal direction thereof;

said heat-sealing device including an upper die and a lower die opposed to said upper die;

said upper die having a block member, a pressing surface provided in a central region of a surface of said block member and a tapered portion provided on side surfaces of said block member, each of said tapered portions incline symmetrically, and at least one accommodation portion provided on each of said tapered portions such that said at least one accommodation portion is spaced at a desired interval in a longitudinal direction of said tapered portion to accommodate a portion of said at least one pair of convexities and concavities, located at both ends of said closing tape in the longitudinal direction thereof; and said lower die having a block member, a pressing surface provided on a surface of said block member and confronting said pressing surface of said upper die, and a tapered portion provided on side surfaces of said pressing surface thereof and approximately confronting said tapered portion of said upper die.

5. An apparatus for producing a compression preservation bag comprising:

a closing structure-producing apparatus to form an annular closing tape;

said closing structure-producing apparatus having a heat-sealing device to thermally fuse end portions of a closing tape having at least one pair of convexities and concavities in a longitudinal direction thereof, and a cutting device to cut said closing tape thermally fused by said heat-sealing device to desired lengths in said longitudinal direction thereof;

said heat-sealing device including an upper die and a lower die opposed to said upper die;

said upper die having a block member, a pressing surface provided in a central region of a surface of said block member, and a tapered portion provided on side surfaces of said block member, each of said tapered portions are arranged to incline symmetrically, and at least one accommodation portion provided on each of said tapered portions such that said at least one accommodation portion is spaced at a desired interval in a longitudinal direction of said tapered portion to accommodate a portion of said at least one pair of convexities and concavities located at both end portions of said closing tape in the longitudinal direction thereof; and said lower die having a block member, a pressing surface provided on a surface of said block member and confronting said pressing surface of said upper die, and a tapered portion provided on side surfaces of said pressing surface thereof and approximately confronting said tapered portion of said upper die.

6. An apparatus for producing a compression preservation bag according to claim 5, wherein each of said at least one accommodation portions includes a first accommodation concavity having a substantially semi-cylindrical shape, and a second accommodation concavity having a substantially triangular shape.

7. An apparatus for producing a compression preservation bag according to claim 5, wherein the area of the pressing surface of said lower die is greater than the area of the pressing surface of said upper die.

8. An apparatus for producing a compression preservation bag according to claim 5, wherein said side surfaces of said lower die further include a relatively wide linear portion, and a relatively narrow linear portion, such that said tapered portion is disposed between said relatively wide linear portion and said relatively narrow linear portion.

* * * * *